United States Patent [19]

Bersch

[11] Patent Number: 4,955,100

[45] Date of Patent: Sep. 11, 1990

[54] APPARATUS FOR CLEANING PIPELINES FOR BEVERAGES AND THE LIKE

[76] Inventor: Friedrich Bersch, Industriestrasse 18, D-5401 Halsenbach, Fed. Rep. of Germany

[21] Appl. No.: 384,208

[22] Filed: Jul. 21, 1989

[30] Foreign Application Priority Data

Jul. 21, 1988 [DE] Fed. Rep. of Germany ..... 3824860
Jul. 21, 1988 [DE] Fed. Rep. of Germany ..... 3824873

[51] Int. Cl.[5] ..... B08B 9/02; F15B 13/02

[52] U.S. Cl. ..... 15/3.51; 137/625; 137/625.48

[58] Field of Search ..... 15/3.51, 3.5, 104.062, 15/; 210/109, 110, 117, 130, 131; 137/118, 119, 493.7, 493, 13, 15, 625.48, 625.49, 625

[56] References Cited

U.S. PATENT DOCUMENTS

| | | | |
|---|---|---|---|
| 2,087,414 | 7/1937 | Schoer | 15/3.51 |
| 3,734,132 | 5/1973 | Kühnelt | 137/625.49 |
| 4,285,268 | 8/1981 | Deckler | 137/119 |
| 4,607,410 | 8/1986 | Bersch | 15/3.51 |
| 4,683,914 | 8/1987 | Brisland | 137/625.48 |
| 4,865,121 | 9/1989 | Ben-Doso | 15/3.5 |

FOREIGN PATENT DOCUMENTS

| | | |
|---|---|---|
| 689234 | 3/1940 | Fed. Rep. of Germany . |
| 2262036 | 12/1972 | Fed. Rep. of Germany . |
| 2548308 | 10/1975 | Fed. Rep. of Germany . |
| 3347003 | 12/1983 | Fed. Rep. of Germany . |
| 973215 | 9/1950 | France . |

*Primary Examiner*—Philip R. Coe
*Assistant Examiner*—Gary K. Graham
*Attorney, Agent, or Firm*—Peter K. Kontler

[57] ABSTRACT

Apparatus for cleaning pipelines for beverages has a shuttle valve with a body which is formed with a sleeve for a reciprocable shuttle. The body has a composite inlet for admission of fresh liquid cleaning agent, and an outlet for spent cleaning agent. Bayonet type connections are provided to separably connect the body with two adapters which are disposed at the ends of the sleeve and are separately connectable with the ends of a pipeline to be cleaned. The shuttle has two ports and two channels as well as two smaller-diameter extensions one of which is received in one of the adapters in a first end position and the other of which is received in the other adapter in a second end position of the shuttle. The latter can be moved between its two end positions by pressurized cleaning agent when the end of the channel in one extension of the shuttle is sealed by one or more sponge-like cleaning elements in the body of cleaning agent which fills the pipeline and flows from the inlet, through one of the ports, through one of the adapters, through the pipeline, the other adapter, the other port, a chamber between the shuttle and the sleeve, and into the outlet. This reverses the direction of flow of cleaning fluid, namely from the inlet to the other port, through the pipeline, the one port, the chamber and into the outlet.

24 Claims, 5 Drawing Sheets

APPARATUS FOR CLEANING PIPELINES FOR BEVERAGES AND THE LIKE

BACKGROUND OF THE INVENTION

The invention relates to apparatus for cleaning pipelines, and more particularly to improvements in apparatus for cleaning pipelines of finite length. Still more particularly, the invention relates to improvements in apparatus which can be used to clean pipelines with liquid cleaning agents, especially with liquid cleaning agents which contain discrete cleaning elements in the form of sponges or the like.

Commonly owned U.S. Pat. No. 4,607,410 discloses a cleaning apparatus with a four-way flow reversing valve which can change the direction of flow of a liquid cleaning agent through a pipeline of finite length. For example, the cleaning agent is an alkaline solution, an acid, tap water or a disinfectant. The apparatus employs two cylindrical housings which are connected to two ports of the valve and each of which is connected or connectable to one end of a discrete pipeline. The other ends of the pipelines are directly or indirectly connected to each other in order to establish a path for the flow of cleaning agent from one housing, through the pipelines and into the other housing. The cleaning elements which float in the stream of cleaning fluid effect a movement of the valving element in the four-way valve to a different position when they enter one of the housings, and the flow of cleaning agent is then reversed until the cleaning elements reach the other housing, and so forth. If the cleaning agent is tap water, spent water is simply discharged by way of the outlet of the cleaning apparatus. If the cleaning agent is an alkaline solution, an acid or a disinfectant, it is normally gathered in a vessel, regenerated and reintroduced into the pipeline or pipelines to be cleaned. The valving element of the four-way valve has a first port which receives cleaning agent from a suitable source (such as a water tap or the aforementioned vessel), and a second port which communicates with the outlet in one position of the valving element. When the direction of flow of cleaning agent is reversed, the first port communicates with the outlet and the second port receives fresh cleaning agent.

The patented apparatus operates quite satisfactorily. However, the cost of the four-way valve is high because the body of such valve is a complex structure which cannot be readily mass-produced in a single operation. The body must be assembled of several precision-finished parts which must be sealingly secured to each other in order to prevent uncontrolled leakage of fresh or spent cleaning agent.

German Pat. No. 689,234 to Wagner discloses a cleaning apparatus which is connectable to two ends of a pipeline and to a source of pressurized liquid cleaning agent. The housing or body of the apparatus has a longitudinally extending passage with ends connected to the ends of the pipeline to be cleaned, and six radially extending ports. Pairs of ports are connected to each other by channels. A reciprocable valving element in the passage of the body can establish or interrupt paths for the flow of liquid between selected ports, and its ends carry sieves for cleaning agent. The diameter of each sieve matches the diameter of the passage in the body. When the interstices of one of the sieves are sealed by cleaning elements in the body of liquid agent which fills the pipeline to be cleaned, the pressure of cleaning agent at the respective axial end of the valving element rises and the latter is caused to move axially to a different position to thus establish communication between different sets of ports in the body of the patented apparatus and to thereby reverse the direction of flow of cleaning agent in the pipeline.

Commonly owned German Pat. No. 33 47 003 discloses a method of and an apparatus for manipulating cleaning elements which swim in and with the liquid cleaning agent. When the apparatus is not in use, the cleaning elements are immersed in a body of sterilizing liquid which is admixed to the cleaning agent when the apparatus is put to renewed use. A similar method is disclosed in the aforementioned commonly owned U.S. Pat. No. 4,607,410.

German Auslegeschrift No. 25 48 308 of Cooper discloses a rather complex system of valves which are to be used in a hydrostatic system including a hydraulic pump and a hydraulic motor and serving to drive motor vehicles or to actuate heavy-duty machinery or other types of machines. Cooper employs a system of valves with two coaxial valves each of which has a discrete movable valving element and which are designed to reverse the direction of flow of a hydraulic fluid along its path.

German Offenlegungsschrift No. 2 262 036 of Kürschner discloses a system of valves wherein a reciprocable displacing element can lift one of two spherical valving elements off its seat so as to connect a control line with that one of two conduits wherein the pressure of fluid is higher.

U.S. Pat. No. 3,734,132 to Kühnelt discloses a shuttle valve which can be used as a pneumatic selector switch to alternately direct incoming impulses from one input to either of two different outputs.

French Pat. No. 973,215 to Fioretti discloses a valve which is to be used in motor vehicles and wherein a solid cylindrical plunger is reciprocable in a valve body between two end positions to establish or interrupt the flow of fluid between selected ports of the body. The purpose of the patented valve is to reduce the likelihood of leakage of fluid and, to this end, the plunger is surrounded by one or more annular seals which are made of leather or another deformable material.

OBJECTS OF THE INVENTION

An object of the invention is to provide a novel and improved pipeline cleaning apparatus which is simpler, more compact and more reliable than heretofore known cleaning apparatus.

Another object of the invention is to provide a novel and improved shuttle valve for use in the above outlined apparatus.

A further object of the invention is to provide a novel and improved body or housing for the shuttle valve.

An additional object of the invention is to provide the apparatus with novel and improved couplings which can connect the body of the shuttle valve to the ends of a pipeline that requires cleaning or rinsing.

Still another object of the invention is to provide the shuttle valve with a novel and improved shuttle.

An additional object of the invention is to provide the valve with novel and improved means for preventing uncontrolled leakage of fresh and spent cleaning agent.

A further object of the invention is to provide the apparatus with novel and improved means for effecting a reversal in the direction of flow of liquid cleaning agent in a predictable manner and at a high frequency.

Another object of the invention is to provide an apparatus wherein a small number of cleaning elements, or even a single cleaning element, suffices to ensure a reversal in the direction of flow of cleaning agent at a desired frequency.

An additional object of the invention is to provide a novel and improved method of ensuring predictable propagation of one or more cleaning elements into engagement with selected portions of the shuttle in a shuttle valve of the above outlined character.

A further object of the invention is to provide a novel and improved inlet for use in a shuttle valve which forms part of apparatus for cleaning pipelines, particularly pipelines which are used to convey beer, wine and/or other beverages.

Another object of the invention is to provide the apparatus with novel and improved means for conveying the cleaning agent along predetermined paths.

SUMMARY OF THE INVENTION

One feature of the present invention resides in the provision of an apparatus for cleaning pipelines of the type having a finite length and serving, for example, to convey beverages. Such pipelines are normally cleaned with a liquid cleaning agent which contains one or more cleaning elements, e.g., in the form of substantially spherical sponges or the like. The improved apparatus comprises a shuttle valve including a body having inlet means for a stream of cleaning agent which can be admitted at a certain pressure, and outlet means for spent cleaning agent. The valve further comprises a sleeve which is integral with the body and has a cylindrical internal surface of constant diameter, a first end and a second end. The valve also comprises a channeled shuttle which is installed in the sleeve and includes two sealing members (e.g., in the form of collars) which are spaced apart from each other in the axial direction of and are in sealing contact with the internal surface of the sleeve. A portion of the shuttle between the sealing members defines with the internal surface a chamber (e.g., an annular chamber), and the apparatus further comprises first hollow coupling means for conveying cleaning fluid between the first end of the sleeve and one end of a pipeline to be cleaned, and second hollow coupling means for conveying cleaning agent between the second end of the sleeve and the other end of the pipeline to be cleaned. The cleaning agent can move the shuttle in the sleeve between a first position in which the shuttle establishes communication between the inlet means and the first coupling means as well as between the second coupling means and the outlet means by way of the chamber, and a second position in which the shuttle establishes communication between the inlet means and the second coupling means as well as between the first coupling means and the outlet means by way of the chamber.

The outlet means has an intake end which is or can be in permanent communication with the chamber, and the inlet means has a discharge end which is or can be maintained in sealing engagement with the aforementioned portion of the shuttle. Such portion of the shuttle has a first port in communication with the first coupling means and a second port in communication with the second coupling means. The inlet means can include a nipple which is provided with the aforementioned discharge end and communicates only with the first port in the first position and only with the second port in the second position of the shuttle. The first port communicates with the chamber in the second position of the shuttle, and the second port communicates with the chamber in the first position of the shuttle. The inlet means can further comprise a portion which is rigid (for example, integral) with the body of the shuttle valve. Such portion of the inlet means and the nipple of the inlet means can be provided with mating threads so that the nipple can be moved axially with reference to the aforementioned portion of the inlet means (i.e., with reference to the body of the shuttle valve), and the apparatus preferably further comprises means (e.g., one or more nuts) for releasably locking the nipple in a selected axial position with reference to the body and with reference to the aforementioned portion of the inlet means.

The aforementioned portion of the shuttle can be provided with an elongated groove which extends in substantial parallelism with the axis of the internal surface, and the discharge end of the nipple preferably extends into such groove. The with of the groove preferably matches or closely approximates the diameter of the discharge end of the nipple, and such discharge end preferably abuts a bottom surface which forms part of the aforementioned portion of the shuttle and is located at the innermost end of the groove. The ports are or can be provided in the bottom surface. The aforementioned portion of the shuttle can be further provided with a first concave surface which is disposed in the groove adjacent the first port, and with a second concave surface which is disposed in the groove adjacent the second port. The preferably cylindrical external surface of the discharge end of the nipple abuts and sealingly engages the first concave surface in the first position and the second concave surface in the second position of the shuttle.

At least that part of the aforementioned portion of the shuttle which defines the groove has a maximum transverse dimension (e.g., a maximum diameter), as seen at right angles to the axis of the cylindrical internal surface, which is less than the constant diameter of the internal surface. This results in the establishment or formation of the aforementioned chamber which is in communication with one of the ports in each of the two positions of the shuttle and which is in permanent communication with the outlet means of the body.

Each of the coupling means can comprise an annular member on the body of the shuttle valve and an adapter which is separably connected with the annular member and is connectable with the respective end of a pipeline which requires cleaning. Each annular member can form part of a bayonet mount or a like mount and can include arcuate rigid sections and elastic or partly elastic sections which alternate with the rigid sections in the circumferential direction of the respective annular member. The body of the shuttle valve and the elastic sections of each annular member can define clearances (e.g., in the form of slots) for reception of cams on the respective adapter. Such clearances can be disposed axially inwardly of the respective elastic sections, and at least one elastic section of each annular member can include portions of different thicknesses as considered in the radial direction of the respective annular member. Such portions of different thickness can serve several purposes, for example, to more reliably hold the cams of the respective adapters as well as to ensure that each adapter can be fixed in a selected angular position with reference to the body of the shuttle valve.

The valve can be further provided with a support for its body, e.g., to separably or permanently affix the valve to the floor in a cellar or elsewhere where the pipelines to be cleaned are normally installed or put to use. For example, the support can include two legs having surfaces which slope in a direction substantially toward the axis of the cylindrical internal surface of the sleeve. Each of the legs can include two mutually inclined portions one of which is rigid (for example, integral) with the body of the shuttle valve. The support can further include reinforcing means (e.g., one or more ribs) extending between one portion of one of the legs and one portion of the other leg. The other portions of the legs can be provided with holes for the shanks of nuts, bolts or like fasteners which can secure the body of the shuttle valve to a floor, to a beam, to a table or to any other holder for the support.

Another feature of the invention resides in the provision of an apparatus which can be used to clean pipelines of finite length, particularly pipelines which serve to convey beverages or the like and are normally cleaned with a liquid cleaning agent which contains one or more cleaning elements, such as the aforementioned spherical sponge or sponges. The apparatus comprises a shuttle valve including a body having inlet means for at least one stream of fresh cleaning agent, outlet means for spent cleaning agent, and a cylindrical internal surface with a first end and a second end. The valve further comprises a shuttle which is installed in the body and includes first and second sealing members which are spaced apart from each other in the axial direction of and are in sealing contact with the internal surface of the body. The shuttle further includes a portion which is disposed between the sealing members and defines with the internal surface a preferably annular chamber, and the shuttle also comprises first and second extensions which have end faces facing away from the aforementioned portion of the shuttle. The first sealing member is disposed between the first extension and the aforementioned portion of the shuttle, and the second sealing member is disposed between the second extension and the aforementioned portion of the shuttle. This portion of the shuttle has first and second ports, and the shuttle is further provided with first and second channels which extend between the first and second ports and the end faces of the first and second extensions, respectively. The maximum diameter of the shuttle preferably equals or very closely approximates the diameter of the internal surface of the body, and the diameters of the extensions are preferably smaller (even much smaller) than the maximum diameter of the shuttle. The apparatus further comprises first hollow coupling means disposed at the first end of the internal surface of the body and defining an internal space serving to convey cleaning agent between the first channel and one end of a pipeline to be cleaned, and second hollow coupling means defining a second internal space which is disposed at the second end of the internal surface of the body and serves to convey cleaning agent between the second channel and the other end of the pipeline to be cleaned. The shuttle is movable with reference to the body of the shuttle valve between a first position in which the inlet means admits cleaning agent into the first port and such cleaning agent flows toward and into the outlet means by way of the first channel, first internal space, the pipeline between the first and second coupling means, second internal space, second channel, second port and the chamber, and a second position in which the inlet means admits one or more streams of cleaning agent into the second port and such cleaning agent flows toward and into the outlet means by way of the second channel, second internal space, the pipeline between the first and second coupling means, first internal space, first channel, first port and chamber. The second extension is at least partially received in the second internal space in the first position of the shuttle, and the first extension is at least partially received in the first internal space in the second position of the shuttle.

The internal spaces can be bounded by internal surfaces having diameters which equal or only slightly exceed the diameters of the respective extensions so that a cleaning element cannot pass between either of the extensions and the respective coupling means, i.e., each cleaning element remains in the coupling means or in the pipeline between the coupling means.

One end of each channel is preferably disposed at least substantially centrally of the respective end face, such one end of at least one of the channels can have a substantially cruciform shape, and at least one of the end faces is preferably conical so that a cleaning element which happens to impinge upon an end face is steered toward and seals the end of the respective channel. This raises the pressure of cleaning agent in the respective internal space, and the pressurized cleaning agent shifts the shuttle with reference to the body of the shuttle valve. In other words, that end of at least one of the channels which is disposed in the respective end face is preferably configurated and dimensioned in such a way that it can be sealed by a single cleaning element, e.g., by a single spherical sponge, especially if the respective end face is conical so that it actually steers an oncoming cleaning element toward the end of the respective channel.

Each extension can include a head or platform and a shank between the head and the respective sealing member.

As mentioned above, each coupling means can comprise an adapter and a bayonet mount or an analogous mount. The adapter is separably connectable to one end of a pipeline to be cleaned, and the bayonet mount serves to separably connect the adapter to the body of the shuttle valve.

The novel features which are considered as characteristic of the invention are set forth in particular in the appended claims. The improved cleaning apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
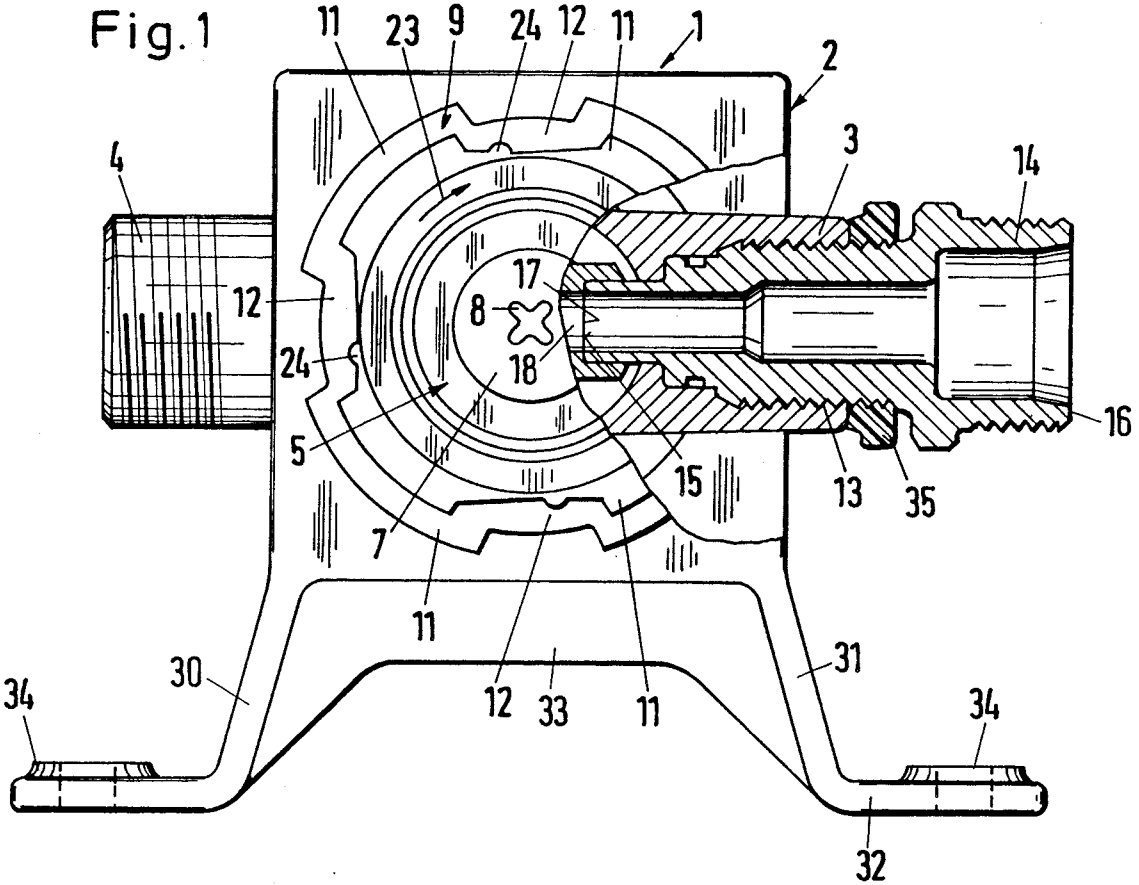
FIG. 1 is a partly end elevational and partly transverse vertical sectional view of an apparatus which embodies one form of the invention, with the adapter of one of the coupling means removed.
Figure 2:
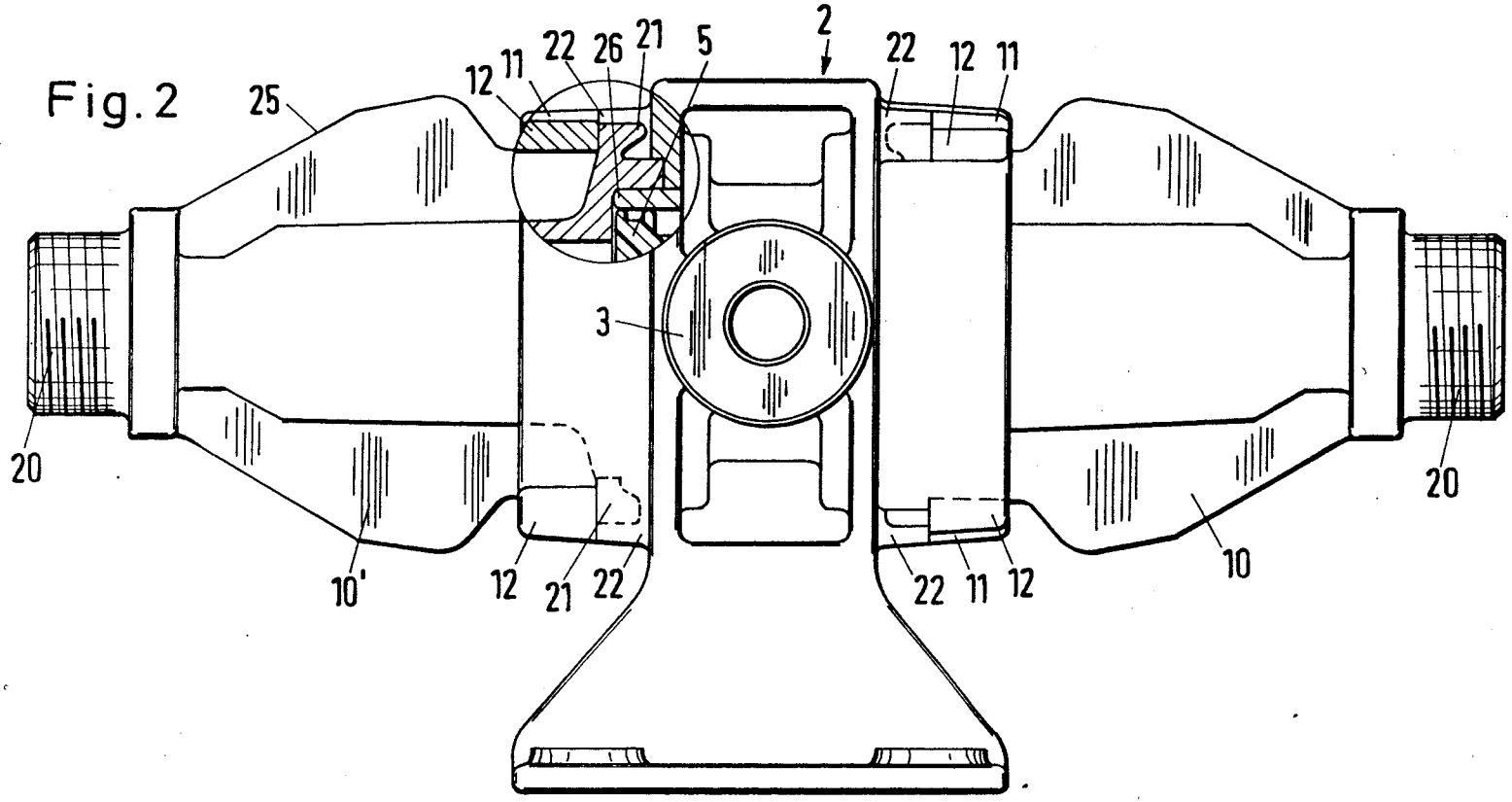
FIG. 2 is a partly side elevational and partly longitudinal vertical sectional view of the apparatus of FIG. 1.
Figure 3:
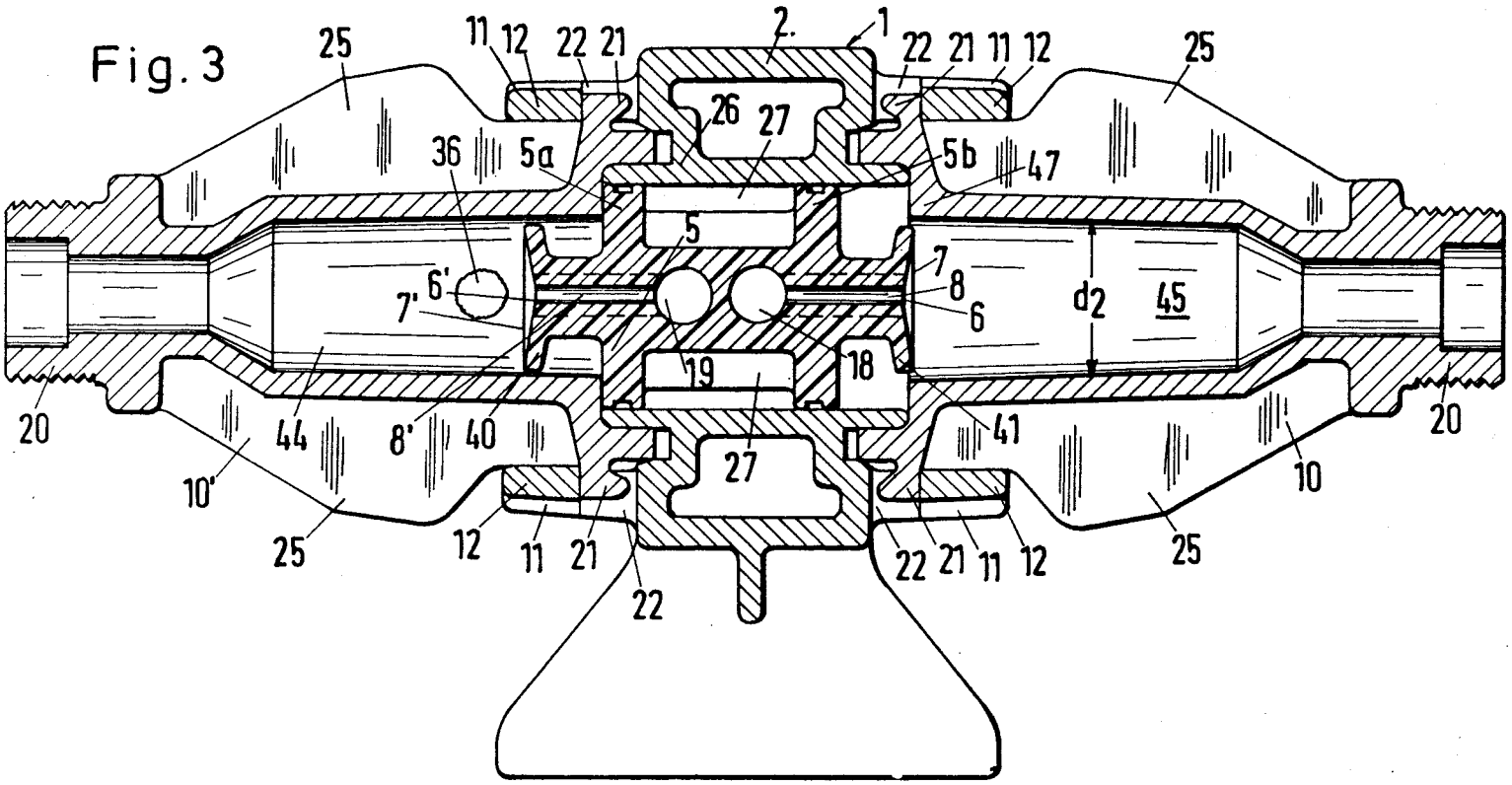
FIG. 3 shows the apparatus of FIGS. 1 and 2 in a full longitudinal vertical sectional view, with the shuttle in the first position.
Figure 4:
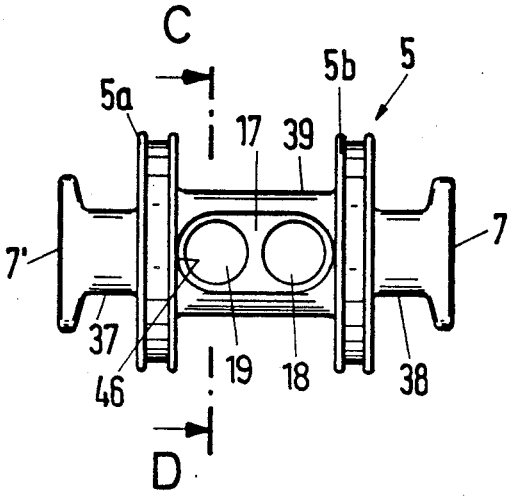
FIG. 4 is an elevational view of the shuttle.
Figure 5:
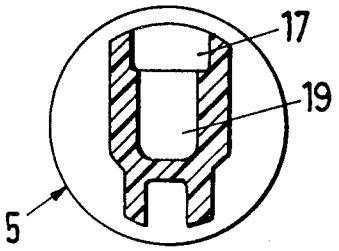
FIG. 5 is a transverse sectional view as seen in the direction of arrows from the line C-D of FIG. 4.

FIGS. 1 to 3 show an apparatus which can be used to clean pipelines for beverages or the like. Pipelines which are to be cleaned with the improved apparatus are of finite length (see the drawing of commonly owned U.S. Pat. No. 4,607,410), i.e., each such pipeline has two ends one of which receives a stream of liquid cleaning agent and the other of which discharges cleaning agent or vice versa. The cleaning agent can be an acid, an alkaline solution, water or a sterilizing fluid, and such cleaning agent can carry one or more cleaning elements (one shown at 36 in the left-hand part of FIG. 3) in the form of spherical and/or otherwise configurated sponges or the like.

The improved apparatus comprises a novel and improved shuttle valve 1, a first coupling device which serves to separably connect the body 2 of the valve 1 with one end of a pipeline to be cleaned, and a second coupling device which serves to separably connect the body 2 with the other end of the pipeline to be cleaned. The valve 1 includes an inlet having a first portion 3 which is rigid (preferably integral) with the body 2, and a second portion in the form of a nipple 14 which is separably connected with the portion 3 by threads 13 and is held in a selected axial position with reference to the portion 3 and body 2 by a locking device 35 in the form of a nut. The body 2 is rigid (preferably integral) with an outlet 4 for spent cleaning agent. When the apparatus is in use, a stream of fresh cleaning agent enters the body 2 by way of the inlet 3, 14 and flows into one end of a pipeline to be cleaned by way of one of the two coupling devices to enter the other coupling device after having passed through the pipeline, and such spent cleaning agent then leaves the body 2 by way of the outlet 4. The shuttle valve 1 can automatically reverse the direction of flow of cleaning agent in cooperation with one or more cleaning elements 36 and the cleaning agent so that the cleaning agent then flows from the inlet 3, 14 toward and into the other end of the pipeline to be cleaned (by way of the other coupling device) to leave the pipeline by way of the one end and to be discharged via outlet 4 after having passed through the one coupling device.

The first coupling device comprises an annular member 9 on the body 2 at one axial end of a one-piece sleeve 26 of the body 2, and a hollow adapter 10 which can be separably connected to the annular member 9 and has a threaded end portion 20 connectable with one end of a pipeline to be cleaned. The other coupling device comprises an annular member 9 which is a mirror image of the annular member of the first coupling device, and a hollow adapter 10' which can be separably connected to the body 2 by way of the respective annular member 9 and has a threaded end portion 20 for connection to the respective end of a pipeline to be cleaned. Each annular member 9 can be said to form part of a bayonet mount or an analogous mount which can establish a quick-release connection between the body 2 of the shuttle valve 1 and the respective adapter 10 or 10'. Each such annular member is integral with the body 2 and includes rigid arcuate sections 11 which alternate with elastic (deformable) sections 12. Each of the two adapters 10, 10' comprises an annulus of cams 21 which are inserted into the respective annular member 9 in such positions that they are at first inwardly adjacent the rigid sections 11. The adapter 10 or 10' is then turned with reference to the corresponding annular member 9 (arrow 23 in FIG. 1) so that the cams 21 are adjacent the inner axial ends of adjacent elastic sections 12 (note particularly FIG. 3) to thereby hold the adapter on the body 2. The inner or rear ends of the elastic sections 12 are spaced apart from and define with adjacent portions of the body slots 22 for the cams 21 of the respective adapters. The elastic sections 12 are deformed axially in response to penetration of cams 21 into the respective slots 22 so that the adapters 10, 10' are reliably and substantially sealingly but separably secured to the body 2 of the shuttle valve 1.

The thickness of elastic sections 12 (as seen in the radial direction of the respective annular members 9) is not constant. Thus, and as can be seen in FIG. 1, the elastic sections 12 have notches 24 bounded by substantially semicylindrical surfaces and serving to receive portions of external projections in the form of axially parallel wings 25 provided on the adapters 10, 10'. The wings 25 locate the respective adapters in predetermined angular positions with reference to the body 2. The wings 25 further serve the purpose of facilitating turning of the adapters 10, 10' in order to connect the adapters with or to disconnect the adapters from the body 2 and/or to threadedly connect the end portions 20 of the adapters to or to disconnect such end portions 20 from the ends of a pipeline.

Figure 6:
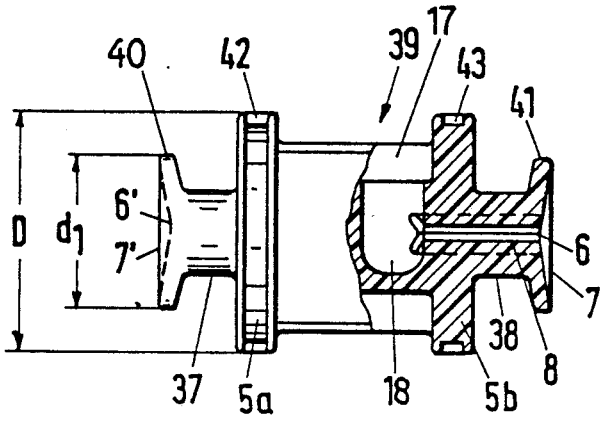
FIG. 6 is a partly elevational and partly axial sectional view of the shuttle in a different angular position.
Figure 7:
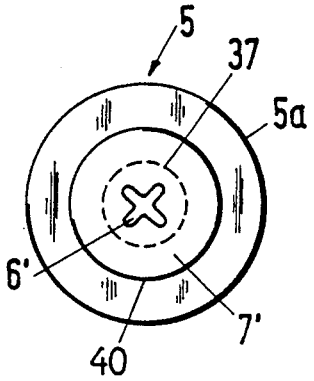
FIG. 7 is an end elevational view of the shuttle as seen from the left-hand side of FIG. 6.

The body 2 of the valve 1 includes the one-piece cylindrical sleeve 26 which has a continuous cylindrical internal surface with a diameter which matches or closely approximates the maximum diameter D (FIG. 6) of a shuttle 5. The latter is reciprocable in the sleeve 26 between a first axial position which is shown in FIG. 3 and a second axial position to the right of the first axial position. The shuttle 5 has two axially spaced apart sealing members **5*a*, 5*b* in the form of collars having circumferentially complete peripheral grooves for annular sealing elements 42, 43 (FIG. 6) which are in sealing engagement with the cylindrical internal surface of the sleeve 26. The smaller-diameter portion 39 of the shuttle 5 between the sealing members 5*a*, 5*b* constitutes a valving element and its peripheral surface is formed with an elongated axially parallel groove 17 bounded in part by a flat bottom surface and in part by concave surfaces 46, one at each longitudinal end of the groove 17. The sealing member 5*b* is inwardly adjacent a first substantially mushroom-shaped extension 41 of the shuttle 5, and the sealing member 5*a* is inwardly adjacent a second substantially mushroom-shaped extension 40. Each extension has a substantially disc-shaped head with a concave end face (7, 7') facing away from the valving element 39, and a shank 38, 37 which connects the head with the respective sealing member (5*b*, 5*a*). The shuttle 5 is further formed with two radially extending ports 18, 19 which extend inwardly from the aforementioned flat bottom surface in the groove 17 and respectively communicate with axially parallel channels 8, 8'. The channel 8 extends through the shank 38 and has a substantially cruciform end 6 in the center of the concave end face 7 of the head of extension 41. The channel 8' extends from the port 19** through the shank 37 and has a substantially cruciform end 6' (see particularly FIG. 7) in the central portion of the concave end face 7' of the head of the extension 40. Each and every portion of each of the two channels 8, 8' can have a cruciform cross-sectional outline.

The valving element 39 and the adjacent portion of the cylindrical internal surface of the sleeve 26 define an annular chamber 27 which is in permanent communication with the passage of the outlet 4 and communicates with one of the ports 18, 19 in each of the two end positions of the shuttle 5. When the shuttle 5 is held in the left-hand end position of FIG. 3, the port 18 is sealed from the chamber 27 by the adjacent discharge end 15 of the nipple 14 and the port 19 communicates with the passage of the outlet 4 via chamber 27. When the shuttle 5 is caused to assume the other (right-hand) end position, the discharge end 15 of the nipple 14 communicates with the port 19 and seals this port from the chamber 27; at the same time, the port 18 communicates with the passage of the outlet 4 by way of the chamber 27.

When the shuttle 5 assumes the end position of FIG. 3, the extension 40 is received in the internal space 44 of the adapter 10'. The diameter d (FIG. 6) of the head of the extension 40 is only slightly smaller than the diameter $d_2$ (FIG. 3) of the cylindrical internal surface bounding the internal space 44 of the adapter 10' or the internal space 45 of the adapter 10. At any rate, the gap between the head of the extension 41 or 40 and the internal surface of the adapter 10 or 10' is too small to permit penetration of a cleaning element 36 into the annular space between the head of the extension 41 or 40 and the adjacent sealing member 5*b* or 5*a*. In other words, the cleaning elements 36 can float back and forth between the concave end faces 7, 7' by flowing in a direction from the end face 7, through the internal space 45, through the pipeline to be cleaned, through the internal space 44 and against the end face 7' or in the opposite direction.

FIG. 1 shows that the hollow cylindrical discharge end 15 of the nipple 14 forming part of the two-piece inlet 3, 14 of the valve 1 extends radially inwardly beyond the portion 3 of the inlet and has a cylindrical peripheral surface which is snugly received in the elongated groove 17 of the valving element 39 in such a way that its end face abuts the bottom surface in the groove. When the shuttle 5 is held in the end position of FIG. 3, the cylindrical peripheral surface of the discharge end 15 of the nipple sealing engages the respective concave (preferably semicylindrical) surface 46 of the valving element 39. The peripheral surface of the discharge end 15 sealingly engages the other concave surface 46 in the groove 17 when the shuttle 5 is moved to the other end position in which the inlet 3, 14 admits fresh cleaning agent into the port 19 whence the cleaning agent flows through the channel 7' into the internal space 44 of the adapter 10' on its way into the pipeline to be cleaned. By loosening the lock nut 35, an operator can change the axial position of the nipple 14 with reference to the other portion 3 of the inlet so as to prevent excessive frictional engagement between the nipple 14 and the valving element 39, to compensate for wear upon the bottom surface in the groove 17 and/or upon the end face of the discharge end 15 and/or to prevent excessive leakage of fresh cleaning agent from the passage of the nipple 14 into the annular chamber 27 (which is in permanent communication with the passage of the outlet 4).

The body 2 of the shuttle valve 1 is integral with a support 30 which has two legs serving to secure the valve to the floor in a cellar or elsewhere in proper position for attachment of the adapters 10, 10' to two end portions of a pipeline to be cleaned and for attachment of the adapters 10, 10' to the respective annular members 9. Each leg has a first section or portion 31 with external surfaces sloping toward the axis of the sleeve 2, and a second portion 32 which is inclined with reference to the portion 31 and has one or more holes 34 for the shanks of screws or bolts (not shown) serving to secure the body 2 to a horizontal floor, to the horizontal top of a table or platform or to any other carrier of the support 30. The latter further comprises a reinforcing rib 33 which extends between the downwardly and outwardly sloping portions 31 of the two legs. The illustrated support 30 is compact, sturdy and practical because it affords convenient access to fasteners in the holes 34 without unduly increasing the space requirements of the apparatus.

The inlet 3, 14 and outlet 4 are disposed opposite each other (FIG. 1), and the two annular members 9 and the respective adapters 10, 10' are disposed at the two axial ends of the sleeve 26.

FIG. 3 shows the shuttle 5 in that end position in which the inlet 3, 14 admits fresh liquid cleaning agent into the port 18 of the valving element 39. At the same time, the discharge end 15 of the nipple 14 cooperates with the valving element 39 to seal the port 18 from the chamber 27. The latter communicates with the passage of the outlet 4 and with the port 19. A stream of fresh cleaning agent flows from the port 18, through the channel 8, through the internal space 45 of the adapter 10, through the pipeline the ends of which are sealingly connected to the end portions 20 of the adapters 10, 10', through the internal space 44 of the adapter 10', through the channel 8', through the port 19, through the chamber 27 and into the passage of the outlet 4. One or more cleaning elements 36 which happen to be in the internal space 45 of the adapter 10 flow through the pipeline to be cleaned and enter the internal space 44 of the adapter 10'. At such time, the extension 40 of the shuttle 5 projects into the internal space 44 so that the foremost floating cleaning element 36 impinges upon the concave and face 7' and is steered toward the adjacent cruciform outer end 6' of the channel 8. The diameter of the illustrated cleaning element 36, the deformability of this cleaning element, the configuration of the end 6' and the dimensions of the end 6' are selected in such a way that a single cleaning element 36 can seal or substantially seal the channel 8' from the internal space 44 whereby the pressure in the interior of the adapter 10' rises because spent cleaning agent can no longer flow into the channel 8' and thence into the passage or the outlet 4. Thus, the rate of flow of cleaning agent into the chamber 27 is reduced to such an extent that the body of liquid cleaning agent in the internal space 44 acts upon the end face 7' and shifts the shuttle 5 to the other end position (not shown) in which the discharge end 15 of the nipple 14 admits fresh cleaning agent into the port 19 and the port 18 communicates with the chamber 27. At the same time, the extension 41 of the shuttle 5 moves into or deeper into the internal space 45 of the adapter 10. The cleaning agent then flows from the inlet 3, 14, through the port 19, channel 8', internal space 44, pipeline to be cleaned, internal space 45, channel 8, port 18, chamber 27 and into the passage of the outlet 4. This induces the advancement of one or more cleaning elements 36 from the internal space 44, through the pipeline (which is cleaned by the cleaning agent and by the cleaning element or elements 36) and into the internal space 45 where a cleaning element 36 impinges upon and is centered by the concave end face 7 to thereby seal the adjacent cruciform outer end 6 of the channel 8. The pressure of cleaning agent in the internal space 45 rises and the pressurized cleaning agent shifts the shuttle 5 back to the position of FIG. 3. The same procedure is repeated again and again as long as the inlet 3, 14 continues to supply fresh cleaning agent, i.e., the shuttle 5 moves back and forth between the two end positions which are determined by the length of the groove 17 in the valving element 39.

It has been found that a single cleaning element 36 suffices to effectively seal the outer end 6 or 6' of the channel 8 or 8' and to bring about immediate shifting of the shuttle 5 from the one to the other end position. The relatively small difference between the diameter of a cleaning element 36 and the diameter $d_1$ of the extension 40 or 41 also contributes to predictable and rapid shifting of the shuttle 5 as soon as a cleaning element 36 reaches the end face 7 or 7'. As mentioned above, the concave end faces 7, 7' actually steer (or at least facilitate a movement of) the cleaning element 36 toward the outer end 6 or 6' of the channel 8 or 8'. The placing of the outer ends 6, 6' of channels 8, 8' into the central portions of the respective end faces 7, 7' also contributes to guidance of a cleaning element 36 toward the outer end 6 or 6' because the stream of cleaning agent flows toward and through the central portion of the extension 40 or 41.

As mentioned above, the end portion 15 of the nipple 14 cooperates with the concave surfaces 46 in the groove 17 of the valving element 39 to determine the extent of axial movability of the shuttle 5 between its two end positions. In addition to such means for determining the two end positions of the shuttle 5, the sealing members **5*a*, 5*b* can cooperate with internal shoulders 47 of the adjacent adapters 10', 10 to arrest the shuttle in the respective end positions. FIG. 3 shows that the left-hand sealing member 5*a* abuts the internal shoulder of the adapter 10' and that the right-hand sealing member 5*b* is spaced apart from the internal shoulder 47 of the adapter 10**.

The configuration and positioning of each of the two concave surfaces 46 in the groove 17 of the valving element 39 are such that the passage of the nipple 14 is in exact register with the port 18 when the cylindrical peripheral surface of the discharge end 15 abuts one of the concave surfaces 46, and that the passage of the nipple 14 is in exact alignment with the port 19 when the peripheral surface of the discharge end 15 abuts the other concave surface 46.

An advantage of the improved apparatus is its simplicity. Thus, the entire body 2 (including the sleeve 26) can constitute a one-piece part which is normally made of a plastic material. Since the axial hole of the sleeve 26 is preferably bounded by a continuous cylindrical internal surface of constant diameter, the finished body 2 can be readily removed from a mold or form. This renders it possible to complete the making of the entire body 2 in a single operation, e.g., in an injection molding machine.

Another advantage of the improved cleaning apparatus is that the sleeve 26 enhances the stability of the body 2 and of the entire shuttle valve 1. This is due to the fact that the sleeve 26 is or can be made of a single piece of plastic or another suitable material and need not exhibit any seams which would weaken the body 2 and/or increase the likelihood of uncontrolled leakage of conveyed cleaning agent. The making of a body 2 with a simple one-piece sleeve 26 is possible because the chamber 27 is located within the confines of the sleeve. Moreover, and since the ports 18, 19 and channels 8, 8' are provided in the shuttle 5 rather than in the body 2, the valve 1 can be provided with a relatively small and compact body.

A further advantage of the improved cleaning apparatus is that the movements of the shuttle 5 between its two end positions take place with a high degree of predictability even though the apparatus is simpler, more compact and less expensive than heretofore known apparatus. The parts of the cleaning apparatus can be mass produced in available machines.

An advantage of the two piece inlet 3, 14 is that the body 2 can be readily removed from the cavity of a mold or the like because the nipple 14 is a separately produced part. Moreover, the composite inlet 3, 14 exhibits the advantage than an operator can readily compensate for wear upon the discharge end 15 of the nipple 14 and/or upon the surfaces bounding the groove 17 in the valving element 39 after a certain period of use of the improved cleaning apparatus. The outer end 16 of the nipple 14 can be connected to the end of a hose or a like part which serves to supply fresh cleaning agent, e.g., an alkaline solution, an acid, fresh tap water, hot water or a disinfectant. The nipple 14 conveys fresh cleaning agent all the way to the port 18 or 19 of the valving element 39 so that the likelihood of excessive leakage of fresh cleaning agent on its way into the channel 8 or 8' is practically nil.

The lock nut 35 enables an operator to locate and retain the nipple 14 in a selected axial position to thus prevent leakage of fresh cleaning agent and/or excessive wear upon the discharge end 15 and valving element 39 as well as to compensate for wear. The likelihood of leakage of fresh cleaning agent and/or of penetration of spent cleaning agent into the port which registers with the passage of the nipple 15 is further reduced due to the fact that the ports 18, 19 are provided in the bottom surface of the valving element 39, i.e., in the deepmost portion of the groove 17, and because the discharge end 15 of the nipple 14 extends all the way into the groove 17 and is in or close to actual sealing engagement with the bottom surface in addition to being in sealing engagement with one of the concave surfaces 46 in each of the two end positions of the shuttle 5. As mentioned above, the concave surfaces 46 can constitute semicylindrical surfaces. The radius of curvature of each semicylindrical surface 46 preferably matches or closely approximates the radius of the peripheral surface of the discharge end 15 of the nipple 14 to thus ensure the establishment of large-area sealing engagement between one of the surfaces 46 and the discharge end 15 in each of the two end positions of the shuttle 5.

The capacity of the chamber 27 need not be substantial, i.e., it is not necessary to enlarge the inner diameter of the sleeve 26 and the maximum diameter D of the shuttle 5 for the express purpose of providing a relatively large chamber 27 which establishes a path for the flow of cleaning agent between the passage of the outlet 4 and the port 18 or 19.

At least the arcuate rigid sections 11 of the annular members 9 can constitute integral parts of the body 2.

This contributes to lower cost of the valve 1 and of the entire apparatus. The annular members 9 render it possible to ensure the attachment of adapters 10, 10' to and their detachment from the body 2 in a simple and time-saving operation. All that is necessary is to move an adapter axially and to thereupon turn the adapter in or counter to the direction of arrow 23. The material of the body 2 can be selected in such a way that the sections 12 of the annular members 9 exhibit a certain amount of elasticity because they are separated from the body 2 by clearances or slots 22. This ensures that the sections 12 can undergo deformation which is necessary or desirable in order to guarantee reliable retention of the adapters 10, 10' in their operative positions. At the same time, the adapters can be readily detached from the body 2 for the purpose of cleaning and/or inspection. The sections 12 yield to the cams 21 of the adapters 10, 10' during angular movement of adapters with reference to the body 2. When the angular movement is terminated, the elastic sections 12 tend to reassume their undeformed condition and to thus obstruct angular movement of adapters away from engagement with the body 2. Turning of the adapters (in or counter to the direction of arrow 23) ensures that the adjacent portions of wings 25 snap into the respective notches 24 and retain the adapters in optimum angular positions with reference to the body 2. The wings 25 of the adapters and the notches 24 of the elastic sections 12 constitute simple but effective male and female detent elements which maintain the adapters in engagement with the body 2 at the respective axial ends of the sleeve 26.

The diameter of that portion of each annular member 9 which is composed of elastic sections 12 is smaller than the diameter of the portion which is formed by the rigid sections 11. This ensures that the elastic sections 12 are outwardly adjacent the cams 21 upon completed axial movement of the adapters at which time the cams 21 are aligned with and can enter the adjacent slots 22 behind the elastic sections 12. The length of each arcuate rigid section 11 (in the circumferential direction of the respective annular member 9) preferably exceeds the length of a cam 21. On the other hand, the length of each elastic section 12 can equal or approximate the length of a cam 21. The dimensions of the cams 21 and those of the slots 22 (and the distance of sections 12 from the body 2 in the axial direction of the sleeve 26) are selected in such a way that the cams 21 are receivable in and can be reliably retained in the respective slots 22 until and unless the operator decides to turn an adapter relative to the body 2 in order to detach the adapter from the valve 1. At least some deformation of elastic sections 12 in the axial direction of the sleeve 26 preferably takes place during movement of cams 21 into the respective slots 22 in order to ensure that the sections 12 remain stressed and oppose accidental separation of adapters 10, 10' from the body 2. Attachment of adapters 10, 10' to and their detachment from the body 2 can be readily carried out by hand. The provision of wings 25 facilitates the task of the operator because such wings can be readily grasped while an adapter is being turned relative to the body 2 and/or vice versa as well as for convenience of insertion of cams 21 in the axial direction of the sleeve 26.

The support 30 or an equivalent support constitutes an optional but desirable feature of the valve 1. This support renders it possible to fixedly install the body 2 in a cellar for beer barrels or wine casks. Reliable mounting of the body 2 on the floor or elsewhere when the apparatus is in use is desirable in order to reduce the likelihood of automatic migration of the body in response to repeated movements of the shuttle 5 between its end positions. The aforediscussed configuration of the legs (31+32) which form part of the support 30 renders it possible to make these legs integral with the body 2 during shaping of the body in an injection molding or another suitable machine. The mutual inclination of the two portions 31, 32 of each leg enhances the stability of the legs and the-convenience of attachment of leg portions 32 to a floor or the like. The rib 33 enhances the stability of the entire support 30 as well as of the body 2.

As a rule, the cleaning apparatus will confine in actual use a number of cleaning elements 36 because such cleaning elements contribute to removal of contaminants from the internal surface of the pipeline which is connected with the end portions 20 of the adapters 10 and 10'. While it is possible to connect each of the ports 18, 19 and the respective end face (7, 7') by way of two or more channels (8 and 8'), a relatively small number of channels (each of which has a single outer end (6, 6') in the respective end face (7, 7') is preferred at this time because this enhances the predictability of movement of shuttle 5 between its two end positions in practically immediate response to impingement of a cleaning element 36 upon the end face 7 or 7' in such position that the cleaning element 36 at least substantially seals the internal space 44 or 45 from the respective channel 8 or 8'. At the very least, a cleaning element 36 which impinges upon the central portion of the concave end face 7 or 7' throttles the flow of cleaning agent to such an extent that the pressure of cleaning agent in the internal space 44 or 45 rises to a value which is necessary to induce the shuttle 5 to move from the one to the other end position. Friction between the sealing elements 42, 43 and the internal surface of the sleeve 2 normally suffices to prevent accidental (premature) axial displacement of the shuttle 5 from the one to the other end position or vice versa.

It is also within the purview of the invention to design the head of each of the extensions 40, 41 in the form of a sieve with a large number of interstices or perforations for the flow of cleaning agent between the channel 8 and the internal space 45 as well as between the channel 8' and the internal space 44. However, and especially if the perforations or interstices are distributed over the entire end faces 7 and 7', it takes a relatively large number of spherical cleaning elements 36 (or otherwise configurated and/or dimensioned cleaning elements) to seal a requisite number of perforations or interstices before the pressure in the internal space 44 or 45 rises sufficiently to ensure that the cleaning agent can move the shuttle 5 from the one to the other end position. Thus, if the heads of extensions 40, 41 are sieves and the number of cleaning elements in the path between the end faces 7 and 7' (including the path portion in the pipeline to be cleaned) is relatively small, the shuttle 5 will be caused to reciprocate at a lower frequency and the cleaning action will be less uniform and is likely to last longer.

The frequency of reciprocation of the shuttle 5 between its end position can be increased by the simple expedient of placing the outer ends 6 and 6' of the channels 8 and 8' at the centers of the respective concave end faces 7, 7' and by designing the extensions 40, 41 and the adapters 10, 10' in such a way that the maximum diameter D of the shuttle 5 appreciably exceeds the diameters $d_1$ of the heads of extensions 40, 41 and the diameters $d_2$ of surfaces bounding the internal spaces 44, 45 of the adapters 10' and 10. The making of the shuttle 5 in such a way that the maximum diameter D is much greater than the diameters $d_1$ of the extensions 40, 41 is particularly desirable and advantageous if the chamber 27 is confined within the sleeve 26, i.e., when the diameter D of the shuttle 5 must be increased in order to ensure the establishment of a chamber 27 having a requisite capacity for reception of a certain quantity of cleaning agent which flows from the port 18 or 19 toward and into the passage of the outlet 4.

The adapters 10, 10' can be made of a transparent or translucent plastic material so that they permit observation of the axial position of the shuttle 5.

The channels 8, 8' can but need not have a cruciform cross-sectional outline. However, such cross-sectional outline is preferred at the present time because the form or cavity in which the shuttle 5 is made can be provided with or can receive a stable core for the making of channels 8 and 8'. In addition, a single spherical cleaning element 36 can be used to seal the end 6' of the channel 8' or the end 6 of the channel 8. The shuttle 5 can be mass-produced in an injection molding or other suitable machine.

An advantage of extensions 40, 41 which include relatively thin flat heads and smaller-diameter shanks 37, 38 is that such design contributes to a reduction of the weight of the shuttle 5 and renders it possible to achieve substantial savings in material without affecting the stability of the shuttle. Moreover, such design of the extensions 40, 41 is desirable and advantageous for convenience of the injection molding operation.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for cleaning pipelines of the type having a finite length and serving to convey beverages and the like with a liquid cleaning agent which contains at least one cleaning element, comprising a shuttle valve including a body having inlet means and outlet means for, cleaning agent, a sleeve integral with said body and having a cylindrical internal surface of constant diameter, a first end and a second end, and a channeled shuttle installed in said sleeve and including two sealing members spaced apart from each other in the axial direction of and in sealing contact with said internal surface, said shuttle further including a portion disposed between said sealing members and defining with said surface a chamber; first hollow coupling means for conveying cleaning agent between the first end of said sleeve and one end of a pipeline to be cleaned; and second hollow coupling means for conveying cleaning agent between the second end of said sleeve and the other end of the pipeline to be cleaned, said shuttle being movable in said sleeve by cleaning agent between a first position in which the shuttle establishes communication between said inlet means and said first coupling means as well as between said second coupling means and said outlet means by way of said chamber, and a second position in which the shuttle establishes communication between said inlet means and said second coupling means as well as between said first coupling means and said outlet means by way of said chamber.

2. The apparatus of claim 1, wherein said outlet means has an intake end in permanent communication with said chamber and said inlet means has a discharge end in sealing engagement with said portion of said shuttle.

3. The apparatus of claim 1, wherein said portion of said shuttle has a first port in communication with said first coupling means and a second port in communication with said second coupling means, said inlet means including a nipple having a discharge end which communicates only with said first port in the first position and only with said second port in the second position of said shuttle, said first port communicating with said chamber in the second position and said second port communicating with said chamber in the first position of said shuttle.

4. The apparatus of claim 3, wherein said inlet means further includes a portion which is rigid with said body, said portion of said inlet means and said nipple having mating threads and said nipple being movable axially with reference to said portion of said inlet means, and further comprising means for releasably locking said nipple in a selected axial position with reference to said portion of said inlet means.

5. The apparatus of claim 3, wherein said portion of said shuttle has a groove which extends in substantial parallelism with the axis of said internal surface and said discharge end of said nipple extends into said groove.

6. The apparatus of claim 5, wherein said discharge end has a predetermined diameter, said groove being elongated and having a width matching or approximating said diameter, said portion of said shuttle having a bottom surface disposed in said groove and abutting said discharge end, said ports being provided in said bottom surface.

7. The apparatus of claim 6, wherein said portion of said shuttle has first and second concave surfaces provided in said groove adjacent said first and second ports, respectively, said discharge end having a peripheral surface sealingly engaging said first concave surface in the first position and said second concave surface in the second position of said shuttle.

8. The apparatus of claim 5, wherein at least that part of said portion of said shuttle which defines said groove has a maximum transverse dimension, as measured at right angles to the axis of said internal surface, which is less than the diameter of said internal surface.

9. The apparatus of claim 3, wherein each of said coupling means includes an annular member on said body and an adapter separably connected with the annular member and connectable with the respective end of the pipeline to be cleaned.

10. The apparatus of claim 9, wherein each of said annular members includes arcuate sections and elastic sections alternating with said arcuate sections.

11. The apparatus of claim 10, wherein said body and said elastic sections define clearances.

12. The apparatus of claim 11, wherein said clearances are disposed axially inwardly of the respective elastic sections.

13. The apparatus of claim 10, wherein at least one of said elastic sections has portions of different thicknesses.

14. The apparatus of claim 1, wherein said valve further comprises a support including legs rigid with said body and having surfaces sloping substantially toward the axis of said internal surface.

15. The apparatus of claim 14, wherein each of said legs includes two mutually inclined portions one of which is rigid with said body.

16. The apparatus of claim 15, wherein said support includes two legs and further comprising reinforcing means extending between said one portion of one of said first and second legs and said one portion of the other of said first and second legs.

17. Apparatus for cleaning pipelines of the type having a finite length and serving to convey beverages and the like with a liquid cleaning agent which contains at least one cleaning element, comprising a shuttle valve including a body having inlet means for cleaning agent, outlet means for cleaning agent and a cylindrical internal surface with a first end and a second end, and a shuttle installed in said body and including first and second sealing members spaced apart from each other in the axial direction of and in sealing contact with said internal surface, said shuttle further including a portion disposed between said sealing members and defining with said internal surface a chamber, said shuttle also comprising first and second extensions having end faces facing away from said portion of said shuttle, said first and second sealing members being respectively disposed between said first and second extensions and said portion of said shuttle, said portion of said shuttle having first and second ports and said shuttle further having first and second channels extending between said first and second ports and the end faces of said first and second extensions, respectively, said shuttle having a predetermined maximum diameter and said extensions having second diameters smaller than said maximum diameter; first hollow coupling means disposed at the first end of said internal surface and defining a first internal space for conveying cleaning agent between said first channel and one end of a pipeline to be cleaned; and second hollow coupling means disposed at the second end of said internal surface and defining a second internal space for conveying cleaning agent between said second channel and the other end of the pipeline to be cleaned, said shuttle being movable in said body between a first position in which said inlet means admits cleaning agent into said first port and such cleaning agent flows toward and into said outlet means by way of said first channel, said first internal space, the pipeline between said coupling means, said second internal space, said second channel, said second port and said chamber, and a second position in which said inlet means admits cleaning agent into said second port and such cleaning agent flows toward and into said outlet means by way of said second channel, said second internal space, the pipeline between said coupling means, said first internal space, said first channel, said first port and said chamber, said second extension being at least partially received in said second internal space at least in the first position of said shuttle and said first extension being at least partially received in said first internal space at least in the second position of said shuttle.

18. The apparatus of claim 17, wherein each of said internal spaces has a third diameter which matches or slightly exceeds the respective second diameter so that a cleaning element cannot pass between either of said extensions and the respective coupling means.

19. The apparatus of claim 17, wherein each of said channels has an end which is disposed substantially centrally of the respective end face.

20. The apparatus of claim 19, wherein at least one of said end faces is concave.

21. The apparatus of claim 19, wherein the end of at least one of said channels is substantially cruciform.

22. The apparatus of claim 19, wherein the end of each of said channels is configurated and dimensioned in such a way that it can be sealed by a single cleaning element.

23. The apparatus of claim 17, wherein each of said extensions includes a head and a shank between the head and the respective sealing member.

24. The apparatus of claim 17, wherein each of said coupling means comprises an adapter connectable with the respective end of a pipeline to be cleaned and a bayonet mount for separably connecting the adapter to said body.

* * * * *